US009936291B2

(12) United States Patent
Christoph

(10) Patent No.: US 9,936,291 B2
(45) Date of Patent: Apr. 3, 2018

(54) SPHERICAL MICROPHONE ARRAY INCLUDING A SOUND DIFFRACTING STRUCTURE WITH CAVITY

(71) Applicant: HARMAN BECKER AUTOMOTIVE SYSTEMS GMBH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 38 days.

(21) Appl. No.: 14/519,987

(22) Filed: Oct. 21, 2014

(65) Prior Publication Data

US 2015/0117672 A1 Apr. 30, 2015

(30) Foreign Application Priority Data

Oct. 25, 2013 (EP) ..... 13190289

(51) Int. Cl.
*H04R 3/00* (2006.01)
*H04R 1/40* (2006.01)
*H04R 5/027* (2006.01)

(52) U.S. Cl.
CPC ..... *H04R 3/005* (2013.01); *H04R 1/406* (2013.01); *H04R 5/027* (2013.01); *H04R 2201/401* (2013.01); *H04S 2400/15* (2013.01)

(58) Field of Classification Search
CPC ..... H04R 3/005; H04R 1/406; H04R 5/027; H04R 2201/401; H04S 7/303; H04S 2400/15
USPC ..... 381/92, 122, 355, 361
See application file for complete search history.

(56) References Cited

U.S. PATENT DOCUMENTS

2005/0123149 A1* 6/2005 Elko ..... H04R 3/005 381/92
2007/0110257 A1 5/2007 Dedieu et al.
2008/0019551 A1* 1/2008 Watanabe ..... H04R 1/406 381/360

FOREIGN PATENT DOCUMENTS

WO 03061336 A1 7/2003

OTHER PUBLICATIONS

Daniel et al., "Improving Spherical Microphone Arrays", Audio Engineering Society, Convention Paper 7479, May 17-20, 2008, Amsterdam, The Netherlands, 9 pages.
Guillaume et al., "Sound Field Analysis With a Two-Dimensional Microphone Array", IEEE, 2006, pp. V-321-V-324.
European Search Report for corresponding Application No. 13 190 289.2, dated Jun. 4, 2014, 8 pages.

* cited by examiner

*Primary Examiner* — Vivian Chin
*Assistant Examiner* — Douglas Suthers
(74) *Attorney, Agent, or Firm* — Brooks Kushman P.C.

(57) ABSTRACT

A spherical microphone array that includes a sound-diffracting structure having a closed three-dimensional shape of at least one non-regular, regular or semi-regular convex polyhedron with congruent faces of regular or non-regular polygons and at least two omnidirectional microphones disposed in or on the sound-diffracting structure on an oval line whose center is disposed on a center line that subtends the center of one of the faces of the regular polygons.

16 Claims, 4 Drawing Sheets

SPHERICAL MICROPHONE ARRAY INCLUDING A SOUND DIFFRACTING STRUCTURE WITH CAVITY

CROSS-REFERENCE TO RELATED APPLICATIONS

This application claims priority to EP Application No. 13 190 289.2, filed Oct. 25, 2013, the disclosure of which is incorporated in its entirety by reference herein.

TECHNICAL FIELD

The disclosure relates to a microphone array, in particular to a spherical microphone array for use in a modal beamforming system.

BACKGROUND

A microphone-array-based modal beamforming system commonly comprises a spherical microphone array of a multiplicity of microphones equally distributed over the surface of a solid or virtual sphere for converting sounds into electrical audio signals and a modal beamformer that combines the audio signals generated by the microphones to form an auditory scene representative of at least a portion of an acoustic sound field. This combination allows for picking up acoustic signals dependent on their direction of propagation. As such, microphone arrays are also sometimes referred to as spatial filters. Spherical microphone arrays exhibit low- and high-frequency limitations, so that the sound field can only be accurately described over a limited frequency range. Low-frequency limitations essentially result when the directivity of the particular microphones of the array is poor compared to the wavelength and the high amplification necessary in this frequency range, which leads to a high amplification of (self-)noise and thus to the need to limit the usable frequency range up to a maximum lower frequency. High-frequency issues can be explained by spatial aliasing effects. Similar to time aliasing, spatial aliasing occurs when a spatial function, for example, spherical harmonics, is under-sampled. For example, in order to distinguish 16 harmonics, at least 16 microphones are needed. In addition, the positions and, depending on the type of sphere used, the directivity of the microphones are important. A spatial aliasing frequency characterizes the upper critical frequency of the frequency range in which the spherical microphone array can be employed without generating any significant artifacts. Reducing the unwanted effects of spatial aliasing is widely desired.

SUMMARY

A spherical microphone array may include a sound-diffracting structure that has a closed three-dimensional shape of at least one non-regular, regular or semi-regular convex polyhedron with congruent faces of regular or non-regular polygons and at least two omnidirectional microphones disposed in or on the sound-diffracting structure on an oval line whose center is disposed on a center line that subtends the center of one of the faces of the regular polygons. The microphone array further comprises a summing circuit that sums up electrical signals generated by the at least two microphones to provide an audio output signal. The summing circuit is configured to attenuate each of the electrical signals with a microphone-specific weighting factor. The microphone-specific weighting factors are configured to provide a windowing function over the microphones.

A spherical microphone array may include a sound-diffracting structure that has a closed three-dimensional shape of at least one non-regular, regular or semi-regular convex polyhedron with congruent faces of regular or non-regular polygons and at least two omnidirectional microphones disposed in or on the sound-diffracting structure on an oval line whose center is disposed on a center line that subtends the center of one of the faces of the regular polygons.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
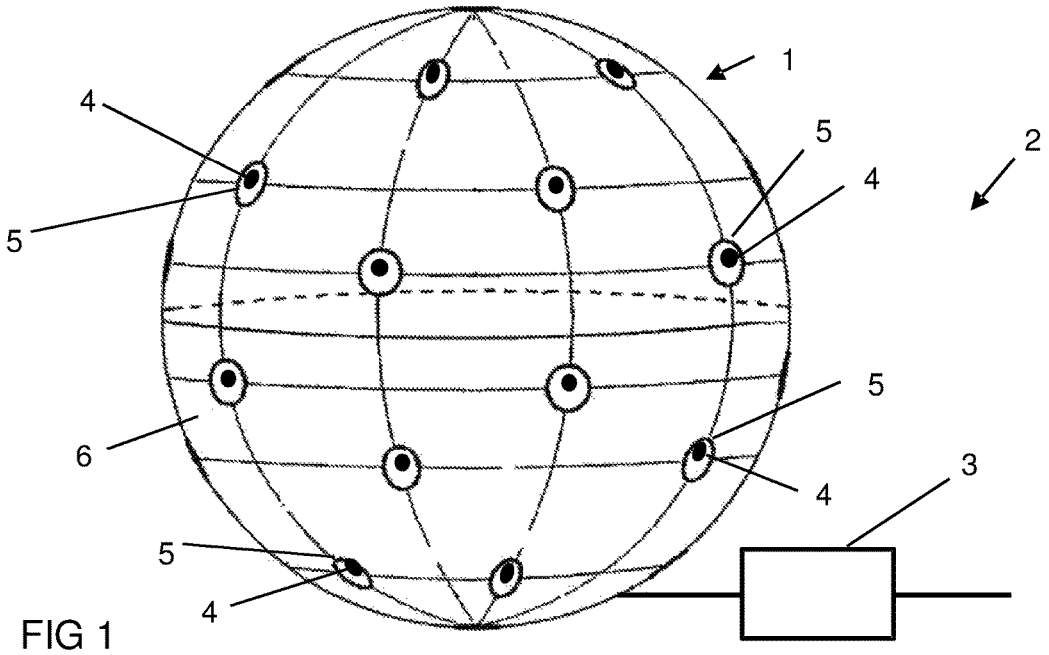
FIG. 1 is a schematic diagram of an exemplary microphone array for use in a modal beamformer system.

FIG. 1 is a schematic diagram of a common array 1 of microphones (herein referred to as microphone array 1) for use in a modal beamformer system 2 that further includes a beamformer unit 3 connected downstream of microphone array 1. Microphone patches 4 may be disposed in a regular or semi-regular fashion over the surface of the rigid sphere. Modal beamformer 3 may include a decomposer (also known as an eigenbeamformer), a steering unit, a compensation unit and a summation unit. Each microphone patch 4 of microphone array 1 generates an audio signal that is transmitted to modal beamformer unit 3 via some suitable (e.g., wired or wireless) connection.

For example, microphone array 1 may comprise 32 microphone patches 4 mounted in optional cavities 5 arranged at the surface of an acoustic rigid sphere 6 in a "truncated icosahedron" pattern serving as a diffracting structure. There are only five possibilities to divide the surface of a sphere into equal areas. These five geometries, which are known as regular polyhedrons or Platonic solids, consist of four, six, eight, 12 and 20 faces, respectively. Another geometry that comes close to a regular division (it is hence called "semi-regular" or "quasi-regular") is the truncated icosahedron, which is an icosahedron with vertices cut off (thus the term "truncated"). This results in a solid consisting of 20 hexagons and 12 pentagons. Other possible microphone arrangements may be based, for example, on other types of platonic solids, Archimedean solids or Catalan solids.

A platonic solid is a regular convex polyhedron with congruent faces of regular polygons and the same number of faces meeting at each vertex. Five solids meet those criteria, and each is named after its number of faces: tetrahedron (four faces), cube or hexahedron (six faces), octahedron (eight faces), dodecahedron (twelve faces) and icosahedron (twenty faces). An Archimedean solid is a highly symmetric, semi-regular convex polyhedron composed of two or more types of regular polygons meeting in identical vertices. They are distinct from the Platonic solids, which are composed of only one type of polygon meeting in identical vertices. A Catalan solid, or Archimedean dual, is a dual polyhedron to an Archimedean solid. The Catalan solids are all convex. They are face-transitive but not vertex-transitive. This is because the dual Archimedean solids are vertex-transitive and not face-transitive. Unlike Platonic solids and Archimedean solids, the faces of Catalan solids are not regular polygons. However, the vertex figures of Catalan solids are regular, and they have constant dihedral angles. Additionally, two of the Catalan solids are edge-transitive: the rhombic dodecahedron and the rhombic triacontahedron. These are the duals to the two semi-regular Archimedean solids. Two of the Catalan solids are chiral: the pentagonal icositetrahedron and the pentagonal hexecontahedron, dual to the chiral snub cube and snub dodecahedron. A spherical microphone array may include a sound-diffracting structure that has a closed three-dimensional shape of at least one non-regular, regular or semi-regular convex polyhedron with congruent faces of regular or non-regular polygons and at least two omnidirectional microphones disposed in or on the sound-diffracting structure on an oval line whose center is disposed on a center line that subtends the center of one of the faces of the regular polygons.

These each come in two enantiomorphs. Not counting the enantiomorphs, there are a total of 13 Catalan solids.

Figure 2:
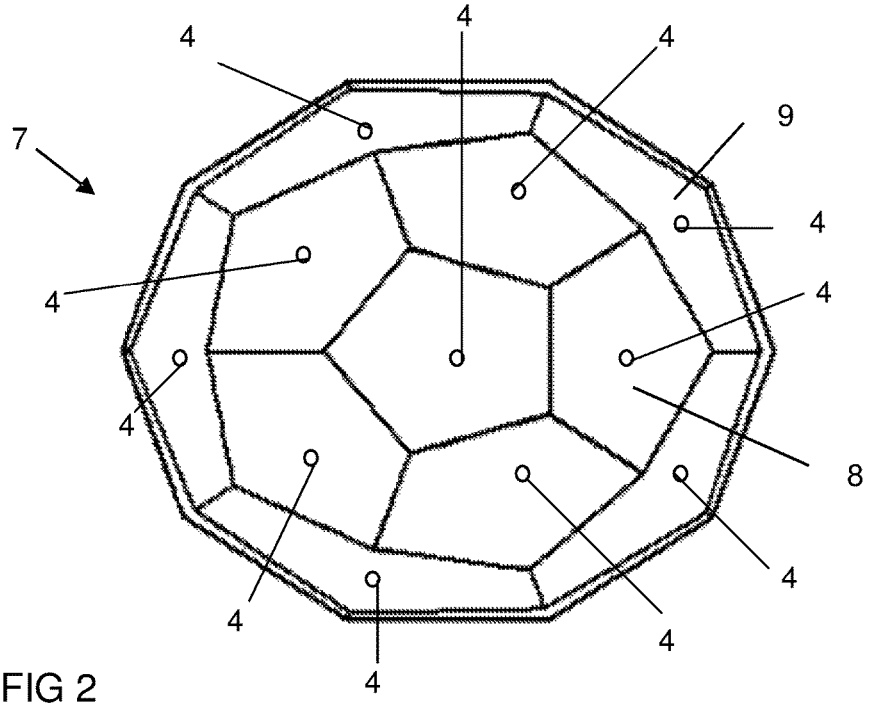
FIG. 2 is a top view of an alternative diffracting structure corresponding to the sphere shown in FIG. 1 that has the shape of a truncated icosahedron.

A more general diffracting structure that corresponds to the sphere shown in FIG. 1 and that has the shape of truncated icosahedron 7 is schematically shown in FIG. 2. In particular, truncated icosahedron 7 is configured to carry 32 microphones and includes icosahedron 9 (Platonic solid with 20 faces, i.e., hexagons) and dodecahedron 8 (Platonic solid with 12 faces, i.e., pentagons). Such an arrangement, where the 12 pentagons of dodecahedron 8 are placed at the poles of a sphere (six at each pole) and the residual 20 hexagons are placed around the equator, leading to a somewhat higher sensor-density there, provides higher accuracy in acoustical applications since humans also have a higher localization accuracy in the horizontal plane than in the vertical plane. The locations of the centers of microphone patches 4 are disposed at the centers of the polygons, for example, the hexagons and pentagons.

In general, the more microphone patches used, i.e., the lower the inter-microphone distance, the higher the upper maximum frequency will be. On the other hand, the cost increases with the number of microphones. The upper maximum frequency, also known as the spatial aliasing frequency, characterizes the upper critical frequency of the frequency range in which the spherical microphone array can be employed without generating any significant artifacts.

In the arrangement shown in FIG. 1, each microphone patch 4 (represented by their center) positioned at the center of a pentagon has five neighbors at a distance of 0.65a, where a is the radius of sphere 6. Each microphone patch 4 positioned at the center of a hexagon has six neighbors, of which three are at a distance of 0.65a and the other three are at a distance of 0.73a. Applying the sampling theorem and taking the worst case, the maximum frequency is 4.7 kHz when radius a=5 cm. In practice, a slightly higher maximum frequency can be expected since most microphone distances are less than 0.73a, namely 0.65a. The upper frequency limit can be increased by reducing the radius of the sphere. On the other hand, reducing the radius of the sphere would reduce the achievable directivity at low frequencies.

One way to improve spherical microphone arrays is to make the microphones more directive. The theory behind this is that the directivity of each sensor should be as close as possible to the desired mode (eigenbeam), which corresponds to high-degree harmonics that have a null contribution. A more directive sensing can be obtained by disposing an omnidirectional microphone at the end of a cavity within the sphere, as disclosed in US patent application publication 2007/0110257A and in Nicolas Epain and Jerome Daniel's paper, "Improving Spherical Microphone Arrays", presented at the 124th Convention of the Audio Engineering Society, 17-20 May 2008, Amsterdam, the Netherlands.

Another approach to prevent the microphone from receiving high-degree spherical harmonics is to use spatial low-pass filtering, i.e., to make the microphones less sensitive to fast variations of the sound field over the surface of the sphere. This is possible if each microphone of the array is able to measure the sound field on an extended area around its angular position. This can be achieved by using larger-membrane microphones. These microphones integrate the pressure variations over their membranes, which can be seen as spatial low-pass filtering.

In the microphone array described herein, cavities 5 are shaped to form both a spatial low-pass filter and a focusing element so that sound entering the cavities from a direction perpendicular to the perimeter of the sphere is collected and transferred to the microphone(s) with the least attenuation. Low-pass filtering may be provided, for example, by cavity shapes whose opening areas are larger than the membrane areas of the microphones. Focusing may be achieved by cavity shapes that concentrate acoustic waves coming into the cavity along an axis perpendicular to the perimeter of the sphere, at a particular point where the respective microphone is to be arranged. Waves coming in from directions other than perpendicular are reflected (diffracted) by the walls of the cavity, which is more efficient the higher the frequency is. Waves with lower frequencies still make their way to the bottom of the cavity, where a center microphone may be disposed, due to diffraction effects occurring at the edge of the cavity. The cutoff frequency is determined by the diameter of the cavity at its edge. As the frequency of incoming sound is increased, sound from a slanting direction reflects more, partly away from the cavity, so that it does not make its way to the microphone disposed in the cavity. The higher the frequency and the greater the diameter, the more spatial the low-pass effect is.

Figure 3:
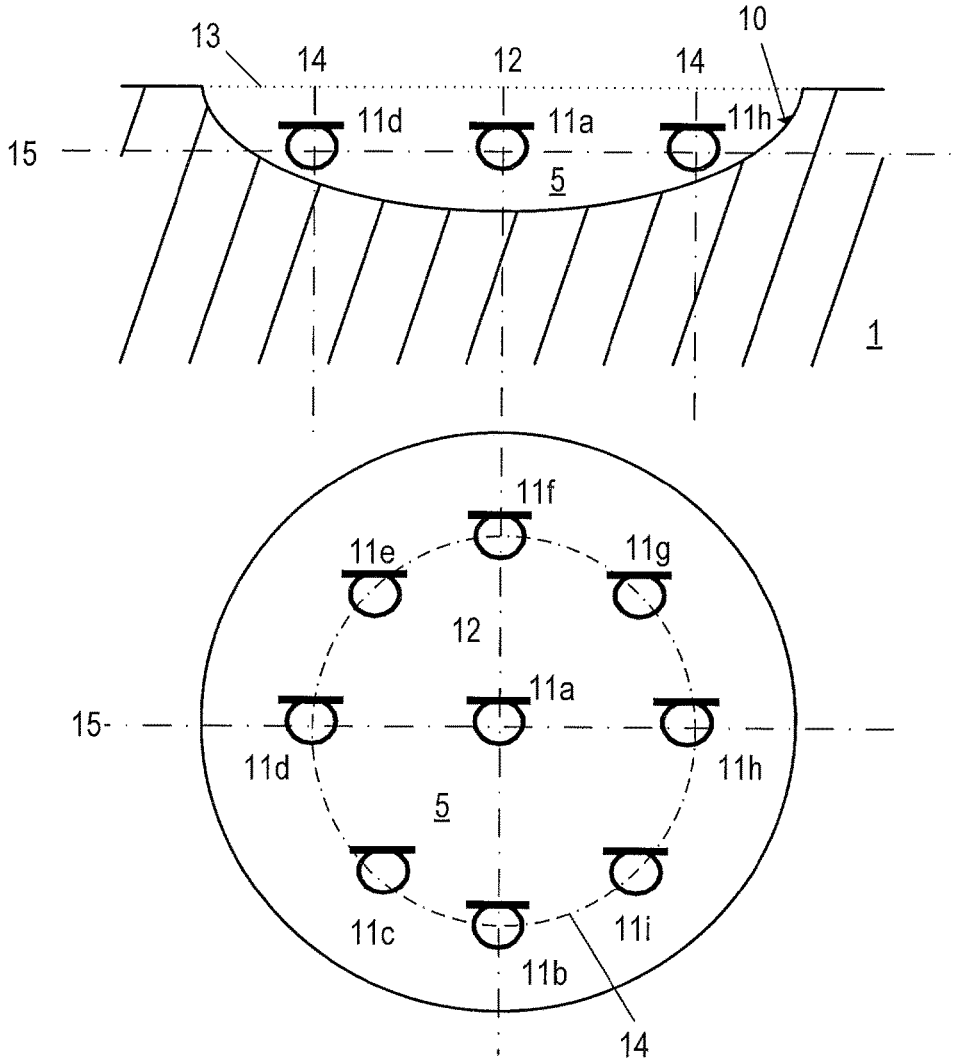
FIG. 3 is a cross-sectional view of a cavity shaped as an inverse spherical cap with a sound-reflective surface and a first microphone patch.

FIG. 3 shows cavity 5 shaped as an inverse spherical cap 10 with a sound-reflective (i.e., solid) surface. A spherical cap may be a portion of a sphere cut off by a plane. If this plane passes through the center of the sphere so that the height of the cap is equal to the radius of the sphere, the spherical cap is called a dome or hemisphere. Accordingly, inverse spherical cap 10 is the cavity into which such a cap fits. In the inverse spherical cap 10, i.e., in cavity 5, nine omnidirectional microphones 11*a*-11*i* are disposed, which may have small membranes. One microphone, optional omnidirectional center microphone 11*a*, is disposed on a (virtual) center line 12 between the end of the cavity and the center of aperture 13 of cavity 5. Center line 12 may be arranged perpendicular to the aperture plane. The other microphones, omnidirectional peripheral microphones 11*b*-11*i*, are disposed on a (virtual) oval line (circle line 14 in the present example), which subtends the center of circle line 14 perpendicular to the surface generated by circle line 14. A circle line as a special case of an oval line is employed in connection with pure icosahedron shapes.

Peripheral microphones 11*b*-11*i* are arranged equidistantly on circle line 14 to form, together with center microphone 11*a*, a regular microphone pattern, herein also referred to as a microphone patch. The bottom part of FIG. 3 shows the patch in a view through the aperture to the end of cavity 5. The upper part of FIG. 3 is a sectional side view of the arrangement of microphones 11*d*, 11*a* and 11*h*, in which aperture 13 is at the top and the end of the cavity is at the bottom. As can be seen, microphones 11*d*, 11*a* and 11*h* are in line (line 15) from both perspectives so that the front sides of microphones 11*d*, 11*a* and 11*h* are coplanar and center microphone 11*a* is not disposed at the end of cavity 5.

Figure 4:
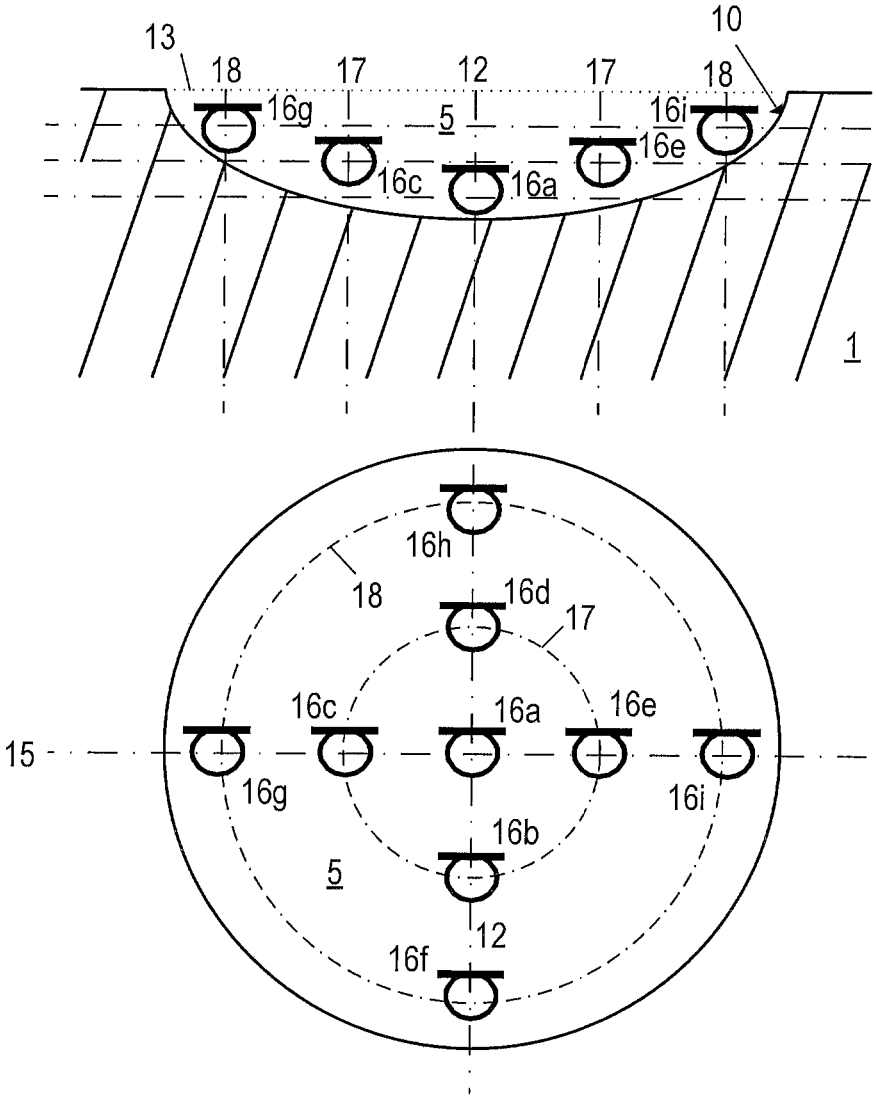
FIG. 4 is a cross-sectional view of a cavity shaped as an inverse spherical cap with a sound-reflective surface and a second microphone patch.

FIG. 4 shows a possible alternative patch arranged in cavity 5. The alternative patch includes, for example, nine microphones 16*a*-16*i*. One microphone, omnidirectional center microphone 16*a*, is disposed on center line 12 between the end of the cavity and the center of aperture 13 of cavity 5. The other microphones, omnidirectional peripheral microphones 16*b*-16*i*, are disposed on two (virtual) circle lines 17 and 18. Center line 12 subtends the centers of circle lines 17 and 18 perpendicular to the surfaces generated by circle lines 17 and 18. Peripheral microphones 16*b*-16*e* are arranged equidistantly on (inner) circle line 17 and peripheral microphones 16*f*-16*i* are arranged equidistantly on (outer) circle line 18. As can be seen from the upper part of FIG. 4, center microphone 16*a* and the microphones on lines 17 and 18 are arranged at different distances from aperture 13. Peripheral microphones 16*f*-16*i* arranged on (outer) circle line 18 are closer to aperture 13 than peripheral microphones 16*b*-16*e* arranged on (inner) circle line 17. Center microphone 16*a* is disposed at the end of cavity 5 and is thus arranged most distant from aperture 13. Alternatively, cavity 5 may be shaped as an inverse circular paraboloid. The center microphone may be disposed at the focal point of the inverse circular paraboloid (e.g., in the arrangement shown in FIG. 4).

Figure 5:
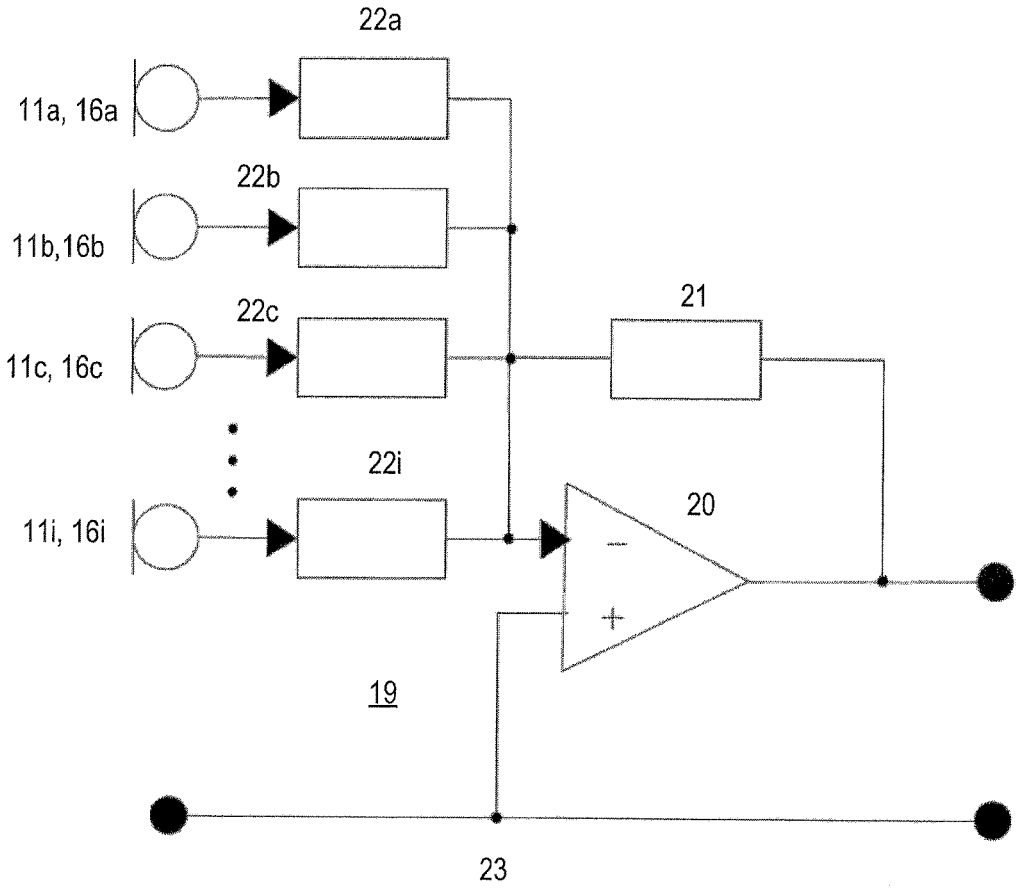
FIG. 5 is a circuit diagram of a summing circuit connected downstream of the microphone patches of FIGS. 3 and 4.

Referring to FIG. 5, summing circuit 19 may be used to couple the microphones of the patches shown in FIGS. 3 and 4. Summing circuit 19 includes, for example, operational amplifier 20 with an inverting input, a non-inverting input and an output. Resistor 21 is connected between output and inverting input of operational amplifier 20 and microphones 11*a*-11*i* or 16*a*-16*i* are connected to the inverting input via resistors 22*a*-22*i*. The non-inverting input is connected to reference point 23. The microphone array of any of claims 1 through 10, further comprising a summing circuit that sums up electrical signals generated by the at least two peripheral microphones and the optional center microphone to provide an audio output signal. Resistors 22*a*-22*i* may have different resistances, and summing circuit 19 may thus attenuate each of the electrical microphone signals with a microphone-specific weighting factor such as a windowing function over the particular microphones.

The usable spectral ranges of the beamformer generally depend on the distance of neighboring microphones. Spatial aliasing is present at a limiting frequency, which will be higher the shorter this distance is. Furthermore, especially when taking modal beamforming into account, microphones have to be placed at the surface of the base body in such a way that certain criteria will be fulfilled, such as the principle of orthonormality (e.g., the orthonormality error matrix should tend to zero). By grouping several microphones in a patch around such a point at the surface of the base body, which marks the center of orthonormality, the usable frequency range of such a microphone array can be extended. All microphones placed within one patch can be easily summed by analog or digital circuitry, eventually employing weighted microphone signals. Even though a higher number of microphones is used, the number of channels for post-processing is equal to the number of patches, and the subsequent signal processing load is thus not increased. Other positive effects that may occur when using microphone patches are that the microphone membrane area is increased, which leads to an increase in directivity, but that the noise generated by the patch is less than that of single microphones having the same microphone membrane area as the patch. Noise reduction NR can be described as follows: NR [dB]=10 log 10(Qp), wherein Qp is the number of microphones per patch.

While various embodiments of the invention have been described, it will be apparent to those of ordinary skill in the art that many more embodiments and implementations are possible within the scope of the invention. Accordingly, the invention is not to be restricted except in light of the attached claims and their equivalents.,

What is claimed is:

1. A spherical microphone array comprising:

a sound-diffracting structure having a closed three-dimensional shape of at least one non-regular, regular or semi-regular convex polyhedron with congruent faces of regular polygons or non-regular polygons;

a cavity disposed in the sound-diffracting structure, the cavity comprising an aperture and an end; and a plurality of omnidirectional microphones including at least two omnidirectional microphones being positioned within the cavity of the sound-diffracting structure on an oval line whose center is disposed on a center line that subtends a center of one of the congruent faces, wherein:

a first omnidirectional microphone of the plurality of omnidirectional microphones is positioned on the center line and at the end of the cavity most distant from the aperture; wherein:

the first omnidirectional microphone is positioned between the at least two omnidirectional microphones;

the microphone array further comprises a summing circuit that sums up electrical signals generated by the at least two omnidirectional microphones to provide an audio output signal;

the summing circuit is configured to attenuate each of the electrical signals with a microphone-specific weighting factor; and the microphone-specific weighting factors are configured to provide a windowing function over the at least two omnidirectional microphones.

2. The spherical microphone array of claim 1, wherein the sound-diffracting structure has the shape of a combination of at least two regular convex polyhedrons or semi-regular convex polyhedrons with the congruent faces.

3. The spherical microphone array of claim 1, wherein the sound-diffracting structure has the shape of an icosahedron, a dodecahedron or a combination thereof.

4. The spherical microphone array of claim 1, wherein a multiplicity of microphones is disposed on a multiplicity of oval lines whose centers are disposed on center lines that subtend the centers of one of the congruent faces.

5. The spherical microphone array of claim 1, wherein the oval line is a circle line.

6. The spherical microphone array of claim 5, wherein the center of the circle line is disposed on a center line that subtends the center of an icosahedron.

7. The spherical microphone array of claim 1, further comprising an omnidirectional microphone disposed on the center line.

8. The spherical microphone array of claim 1, wherein the at least one cavity is shaped as an inverse spherical cap or inverse circular paraboloid.

9. The spherical microphone array of claim 1, wherein the cavity comprises a sound reflective surface.

10. A spherical microphone array comprising:

a sound-diffracting structure having a closed three-dimensional shape of at least one non-regular, regular or semi-regular convex polyhedron with congruent faces of regular polygons or non-regular polygons;

a plurality of omnidirectional microphones including at least two omnidirectional microphones being positioned within a cavity of the sound-diffracting structure on an oval line whose center is disposed on a center line that subtends a center of one of the congruent faces; and a first omnidirectional microphone of the plurality of omnidirectional microphones being positioned on the center line and at an end of the cavity most distant from an aperture of the cavity, wherein the first omnidirectional microphone is positioned between the at least two omnidirectional microphones.

11. The spherical microphone array of claim 10, wherein the sound-diffracting structure has the shape of a combination of at least two regular convex polyhedrons or semi-regular convex polyhedrons with the congruent faces.

12. The spherical microphone array of claim 10, wherein the sound-diffracting structure has the shape of an icosahedron, a dodecahedron or a combination thereof.

13. The spherical microphone array of claim 10, wherein a multiplicity of microphones is disposed on a multiplicity of oval lines whose centers are disposed on center lines that subtend the centers of one of the congruent faces.

14. The spherical microphone array of claim 10, wherein the first omnidirectional microphone and the at least two omnidirectional microphones are arranged at different distances from one another within the cavity.

15. The spherical microphone array of claim 10, wherein the cavity is shaped as an inverse spherical cap or inverse circular paraboloid.

16. A spherical microphone array comprising:

a sound-diffracting structure having a closed three-dimensional shape of at least one non-regular, regular or semi-regular convex polyhedron with congruent faces of regular polygons or non-regular polygons;

a plurality of omnidirectional microphones including at least two omnidirectional microphones being positioned within a cavity of the sound-diffracting structure on an oval line whose center is disposed on a center line that subtends a center of one of the congruent faces;

a first omnidirectional microphone of the plurality of omnidirectional microphones being positioned on the center line and at an end of the cavity most distant from an aperture of the cavity; and a summing circuit that sums up electrical signals generated by the at least two omnidirectional microphones to provide an audio output signal;

wherein the summing circuit is configured to attenuate each of the electrical signals with a microphone-specific weighting factor; and wherein the microphone-specific weighting factors are configured to provide a windowing function over the at least two omnidirectional microphones to attenuate each of the electrical signals.

* * * * *